US005194023A

United States Patent [19]

Stone

[11] Patent Number: 5,194,023

[45] Date of Patent: Mar. 16, 1993

[54] INDIVIDUAL PROPELLED WATER CRAFT

[76] Inventor: Edward Stone, 105-3150 Gladwin Rd., Abbotsford, B.C., Canada, V2S 6W8

[21] Appl. No.: 824,972

[22] Filed: Jan. 24, 1992

[51] Int. Cl.[5] ..... B63H 1/32; B63H 16/16

[52] U.S. Cl. ..... 440/20; 440/25

[58] Field of Search ..... 440/17, 19, 20, 21, 440/25, 26

[56] References Cited

U.S. PATENT DOCUMENTS

| | | | |
|---|---|---|---|
| 2,940,090 | 6/1960 | Foornier | 9/310 |
| 3,324,820 | 6/1967 | Fekele | 115/36 |
| 3,609,782 | 10/1971 | Seiichimabuchi | 9/310 |
| 3,756,187 | 9/1973 | Livaudais | 115/28 |
| 4,157,597 | 6/1979 | Trebnick | 9/310 |
| 4,295,236 | 10/1981 | Upchurch . | |
| 4,379,701 | 4/1983 | David | 440/21 |
| 4,459,118 | 7/1984 | Schaumann | 441/76 |
| 4,541,809 | 9/1985 | Schaumann | 441/76 |
| 4,591,343 | 5/1986 | Schaumann | 441/76 |
| 4,599,072 | 7/1986 | Pollini | 441/65 |
| 4,618,329 | 10/1986 | Celez | 441/76 |
| 4,624,646 | 11/1986 | Strohmeir | 441/76 |
| 4,681,551 | 7/1987 | Morris | 441/76 |
| 4,731,039 | 3/1985 | Zeiss | 441/76 |
| 4,772,237 | 9/1988 | Zalkauskas | 440/96 |
| 4,795,381 | 1/1989 | Willems | 440/26 |
| 4,804,345 | 2/1989 | Lee | 440/21 |
| 4,846,743 | 7/1989 | Ping-Chuan | 441/77 |
| 4,915,659 | 4/1990 | Sanders | 441/76 |
| 4,954,106 | 9/1990 | Shuh-Chin | 440/21 |
| 4,985,006 | 1/1991 | Brunet | 441/76 |

FOREIGN PATENT DOCUMENTS

| | | | |
|---|---|---|---|
| 3502273 | 7/1986 | Fed. Rep. of Germany | 440/24 |
| 2602738 | 2/1988 | France | 440/24 |
| 604156 | 4/1960 | Italy | 440/25 |

*Primary Examiner*—Sherman Basinger
*Attorney, Agent, or Firm*—Townsend and Townsend

[57] ABSTRACT

A recreational water craft is propelled by an individual using cross country skiing action. The weight of the operator is supported on a platform between two parallel floats thus providing a stable craft. The water craft comprises two longitudinal floats with a connecting frame, a first guide rail is mounted on the connecting frame having a first foot supporting trolley constrained to move backwards and forwards on the first guide rail, a second guide rail substantially parallel to the first guide rail mounted on the connecting frame, having a second foot supporting trolley constrained to move backwards and forwards on the second guide rail, a propulsion arrangement for moving the craft through the water when the first trolley or second trolley are moved backwards and forwards on the first or second guide rails, and a steering arrangement to direct direction of movement of the craft through the water.

13 Claims, 5 Drawing Sheets

Fig. 3.
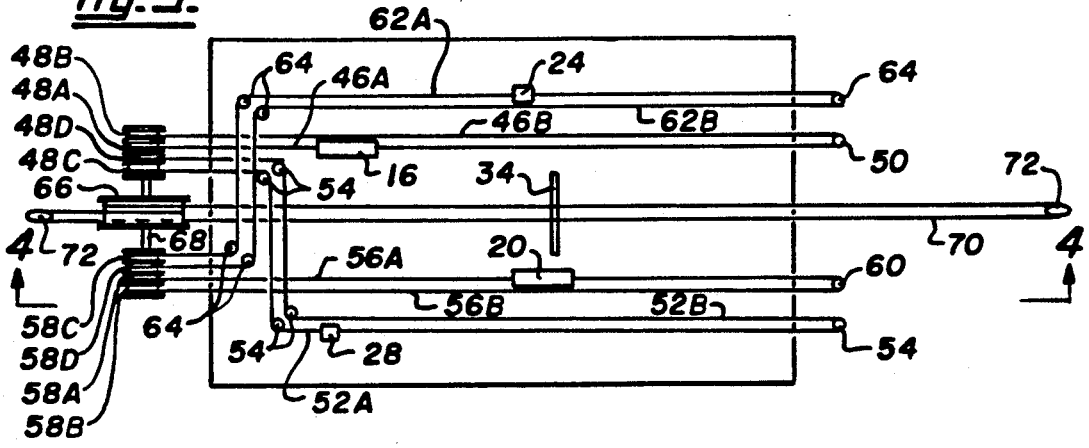
Fig. 4.
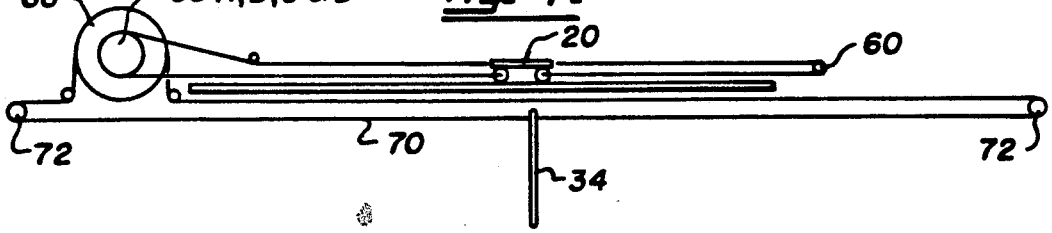
Fig. 6.
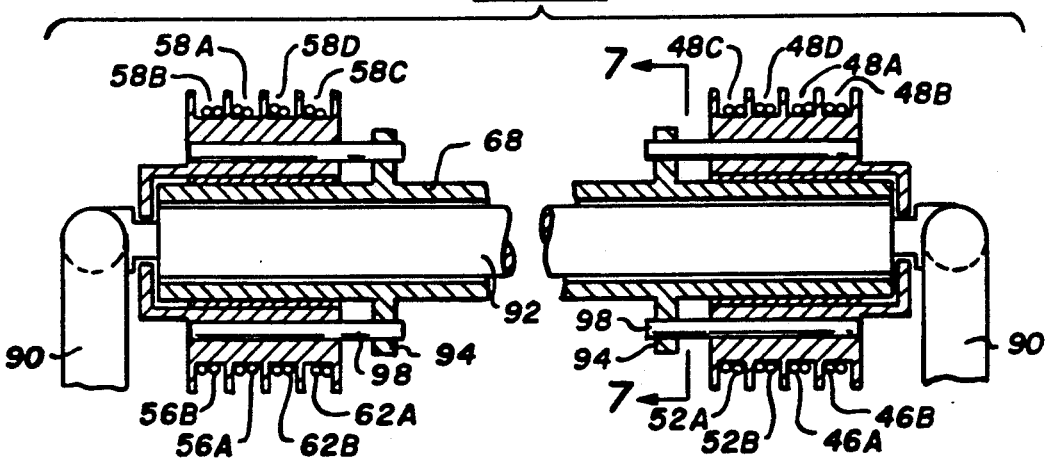
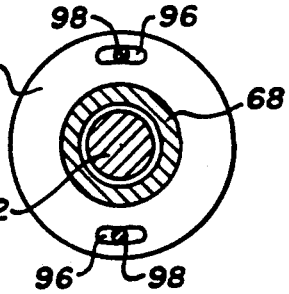
Fig. 7.
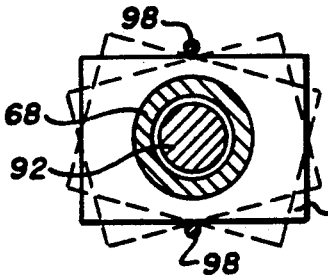
Fig. 7A.

70
66
6
58A
58B
58D
58C
68
48D
48C
48A
48B
6
90
90
62A
56B
56A
62B
52A
52B
46B
46A
14
80
86
86
82
84
84
82
88
76
76
78
74
20
16

24
109
108
110
120
62B
62A
26
124

24
108
120
13
13
26
124

124
108
122
24
108
120
124

INDIVIDUAL PROPELLED WATER CRAFT

TECHNICAL FIELD

The present invention relates to a recreational water craft which may be propelled and controlled by an individual. More specifically the present invention provides a recreational water craft which utilizes cross-country skiing action to propel the water craft on water.

BACKGROUND ART

Individually propelled water crafts such as rowing boats, paddle boats, etc., are known. There are water crafts and vessels which include paddles operated by rotating pedals on crank arms similar to the operation of a bicycle. There has also been an attempt to make skis that one can use on the water. In the past this concept of utilizing floating skis has not been successful simply because it is difficult to keep the skis oriented and pointing in one direction and unless the water is very still, progression on the water does not occur. If the skis comprise floats then by moving them backwards and forwards there is no resultant force to move the skier in the desired direction.

DISCLOSURE OF INVENTION

It is an aim of the present invention to provide a recreational water craft that can be propelled by an individual performing a cross-country skiing action moving both feet and arms as though one was skiing. Furthermore a paddle is provided that generates a driving force to propel the craft. In one embodiment the paddle moves at a faster speed through the water than the speed of foot movement performing the skiing action, thus the speed of the craft through the water is not limited to the speed of foot movement. The water craft is formed of two floats linked together by a connecting frame and the individual stands on trolleys or skates that move in tracks on the frame and have poles that also move in tracks on the frame. The poles when in a forward position are used for steering the water craft. The weight of the operator is not directly on the floats as in known devices, but is supported on the frame between the floats. This provides more stability for the craft against roll.

The present invention provides an individual propelled water craft comprising; two longitudinal floats adapted to float on water, connecting frame means supporting the two floats in a spaced apart and parallel configuration, first guide means mounted on the frame means having a first foot supporting trolley constrained to move backwards and forwards within the first guide means, second guide means substantially parallel to the first guide means, mounted on the frame means having a second foot supporting trolley constrained to move backwards and forwards within the second guide means, propulsion means for moving the craft on water when the first trolley or second trolley are moved backwards and forwards in the first guide means or the second guide means, and steering means to direct direction of movement of the craft on water.

BRIEF DESCRIPTION OF DRAWINGS

In drawings which illustrate embodiments of the present invention:

FIG. 3 is a schematic plan view showing the arrangements of the transmission cords for the water craft of the present invention;

FIG. 4 is an elevational view showing the arrangement of the transmission cords shown in FIG. 3;

FIG. 6 is a partial sectional view taken at line 6—6 of FIG. 5;

FIG. 7 is a sectional view taken at line 7—7 of FIG. 6;

FIG. 7A is another embodiment of a sectional view taken at line 7—7 of FIG. 6;

BEST MODE FOR CARRYING OUT THE INVENTION

Figure 1:
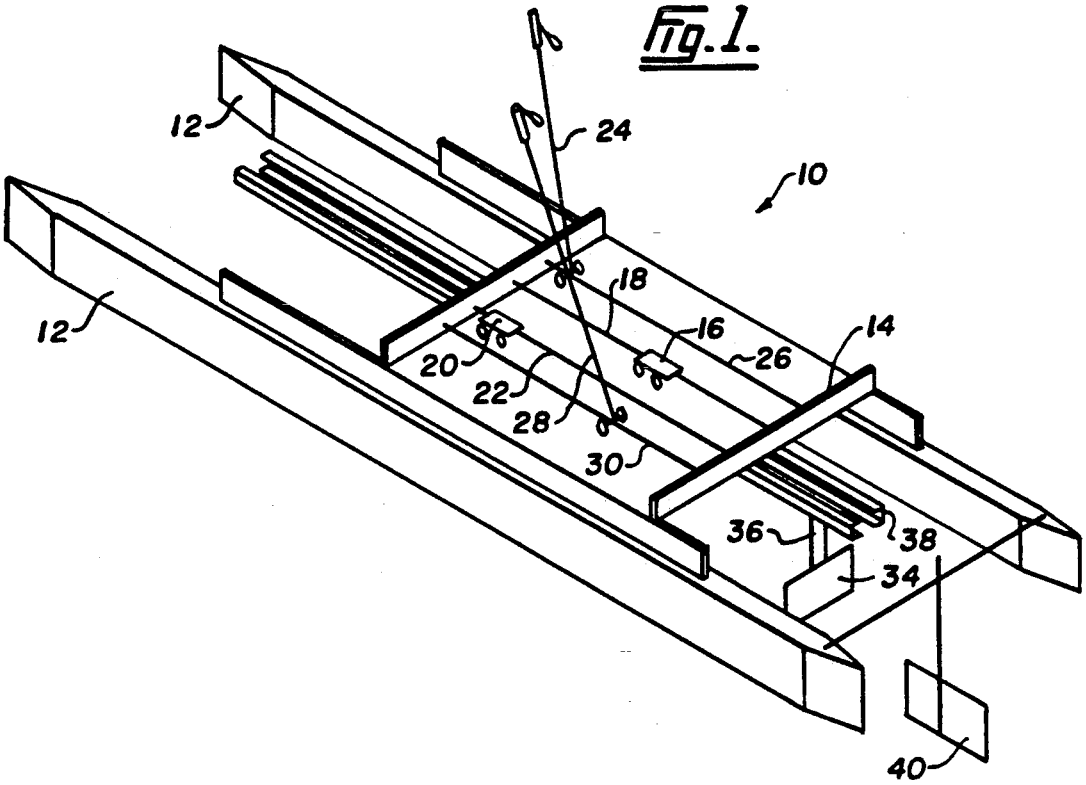
FIG. 1 is an isometric view showing one embodiment of a water craft according to the present invention.
Figure 2:
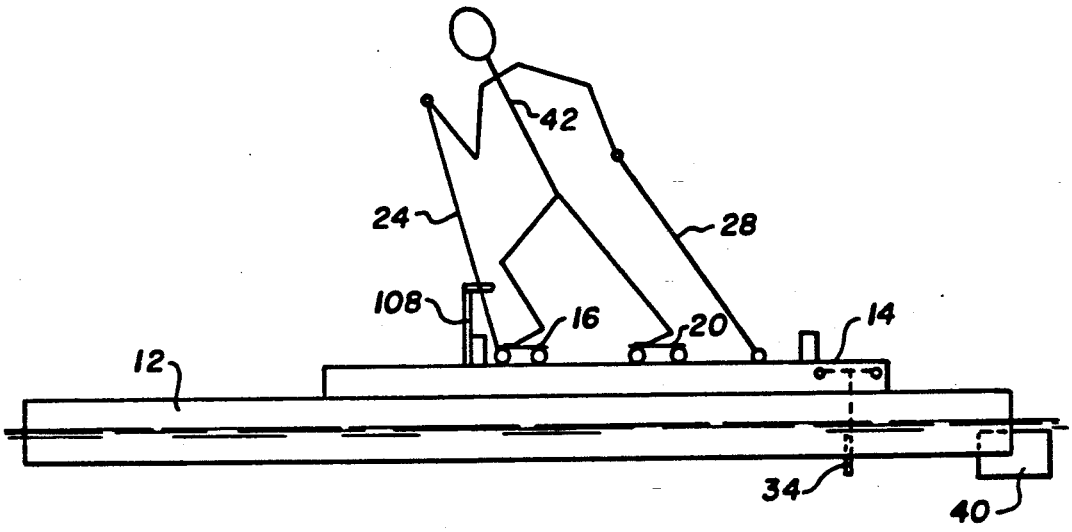
FIG. 2 is a schematic longitudinal view showing an individual on a water craft according to the present invention.

A water craft according to one embodiment of the invention is illustrated in FIGS. 1 and 2. The craft 10 has two longitudinal floats 12 substantially parallel to each other spaced apart and supported by a frame 14 which has four tracks thereon. A first foot supporting trolley 16 is constrained to move backwards and forwards in a first guide rail arrangement 18, a second foot supporting trolley 20 is constrained to move backwards and forwards in a second guide rail arrangement 22. Outside the first guide rail arrangement 18 is a first pole 24 which is constrained to move backwards and forwards in a first pole guide channel arrangement 26 and a second pole 28 is constrained to move in a second pole guide channel arrangement 30 outside the second guide rail arrangement 22.

The trolleys 16, 20 may have straps to hold a foot in a boot or shoe, or may have front and back holds made of flexible materials similar to a water ski foot attachments.

A paddle blade 34 is supported by a paddle arm 36 to move in paddle guide channels 38 which are substantially parallel to the floats 12 and supported underneath the frame 14. A rudder 40 is shown at the back of the craft 10. As seen in FIG. 2 an individual 42 is shown in a typical cross-country skier's motion and it is this motion that propels the water craft. The tracks upon which the individual 42 moves may constitute a deck for ease of attaching ones feet to the first and second trolleys 16 and 20.

Materials of construction are suitable materials, such as fiberglass, plastic, wood, with the guide rails and channels being formed from metal, such as non-corrosive steel, aluminum, etc., or suitable plastic materials. In another embodiment, the floats 12 are formed of inflated rubber members. The members may be in one or several sections, and be supported by a frame that is collapsible for ease of storage and transportation.

The arrangement of the propulsion system is illustrated in FIGS. 3 and 4. In order to ensure that the cross-country skiing movement is attained, the first trolley 16 and the second pole 28 are linked together so that they move together both forwards and backwards. Similarly, the second trolley 20 and the first pole 24 are also linked together. In order to ensure that an individual is able to push only one trolley and pole backwards, there is an arrangement wherein one trolley and one pole are locked at a forward position. Then when the other trolley and pole are brought up into this forward position, there is an escape mechanism to release the locked trolley and pole. In this way movement occurs between one leg and arm, followed by the second leg and arm. In each case the movement is transferred to move the paddle 34 in a propulsion stroke and then return the paddle 34 in a return stroke. An arrangement is provided to raise the paddle 34 out of the water so no force is applied to the water on the return stroke.

The first trolley 16 shown in FIG. 3 is in the first locking position and is connected to a drive cord 46A which extends from a first driver spool 48A at the front end. A return cord 46B attached to the rear of the first trolley 16 passes around a rear sheave 50 at the rear of the frame 14 and extends forward to a first return spool 48B. The drive cord 46A unwinds from the first driver spool 48A when the first trolley 16 moves backwards and the return cord 46B winds onto the first return spool 48B. The reverse occurs when the trolley 16 moves in the return stroke. Similarly, second pole 28 is also in the first locking position and is connected by a drive cord 52A unwinding from a first driver spool 48C, and a return cord 52B from the second pole 28 passing around a number of sheaves 54 to the first return spool 48D. The drive spools 48A and 48C and the return spools 48B and 48D are all formed in a single driver with flanges separating the spools. In another embodiment they may be separate spools side-by-side on a single axis. The second trolley 20 is connected to a drive cord 56A and a return cord 56B which extend from a second driver spool 58A and a second return spool 58B at the front end around a rear sheave 60. Similarly, the first pole 24 is connected by a drive cord 62A and a return cord 62B passing around a number of sheaves 64 to the second driver spool 58C and second return spool 58D. The individual operating the water craft has the first trolley 16 and the second pole 28 locked, and moves the second trolley 20 and the first pole 24 backwards by pushing against the fixed trolley and pole. The second spools 48A, B, C and D rotate and this in turn rotates a driven spool 66 by means of drive shaft 68. The driven spool 66 has a larger diameter than the spools 48A, B, C and D and 58A, B, C and D and paddle transmission cord 70 attached to the driven spool 66 has a higher speed and greater movement than the drive and return cords for the trolleys and poles. As can be seen in FIGS. 3 and 4, the transmission cord 70 from the driven spool 66 passes over sheaves 72 at the front and the back of the water craft and is connected to the front and back of a paddle trolley which supports paddle 34 thus providing movement of the paddle 34 backwards and forwards.

Figure 5:
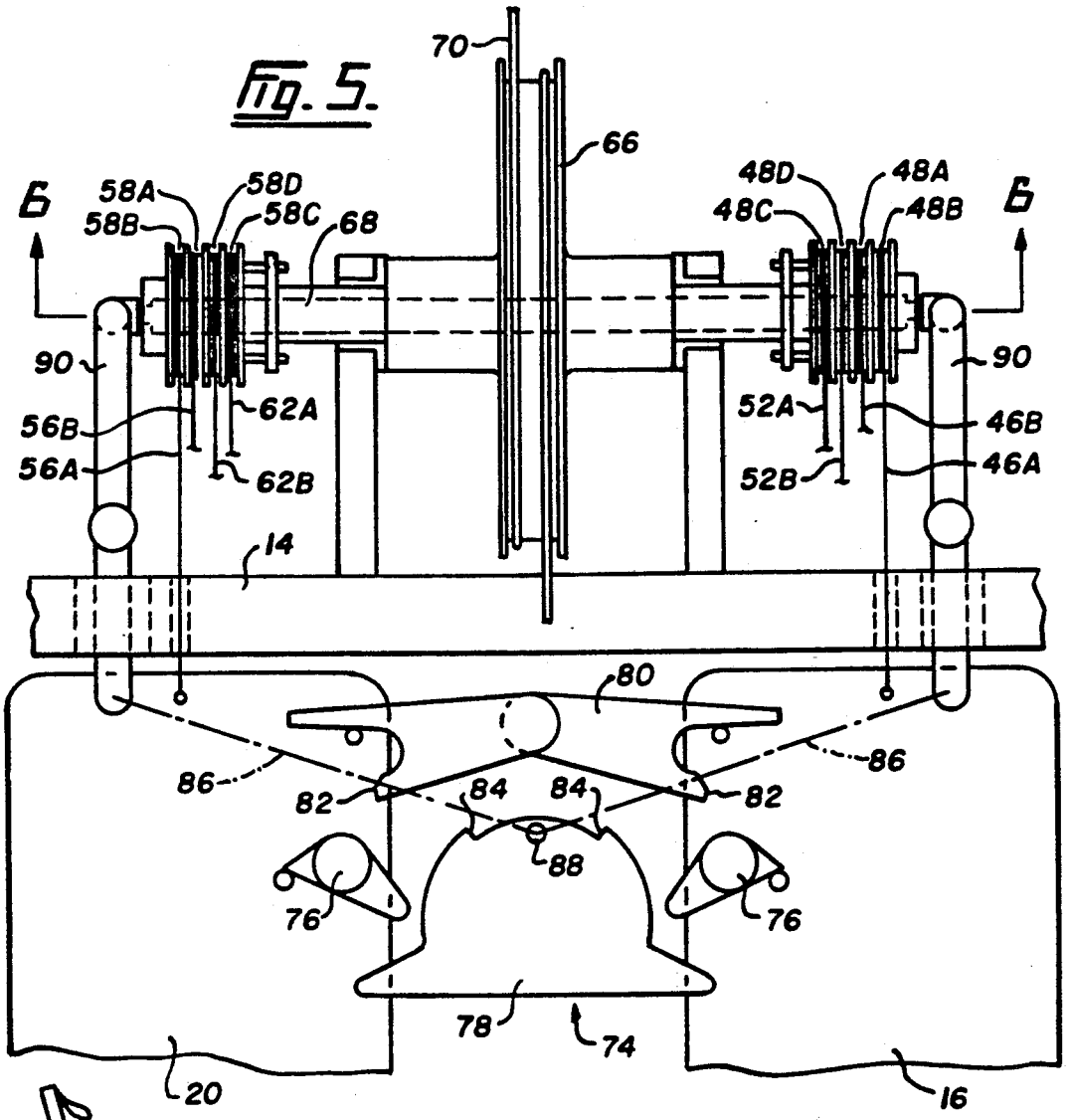
FIG. 5 is a partial plan view showing the escapement mechanism for the foot supporting trolleys and the sheaves for the transmission cords.

The escape mechanism 74 is illustrated in FIG. 5. This mechanism ensures that when either the first or second trolleys 16 and 20 moves rearwards, the remaining trolley is locked in the forward position. A spring loaded pawl 76 is mounted on each trolley 16,20 and strikes an escapement plate 78 as the escaping trolley 16,20 moves rearward. This rotates the escapement plate 78 until a catch plate 80 operates. The catch plate 80 prevents the escapement plate 78 from rotating in the opposite direction by means of a lever portion 82 on the catch plate 80 engaging in one of the notches 84 on the escapement plate 78. The remaining trolley 16,20 is locked in the forward position while the backward moving trolley 16,20 is free to continue moving backwards and forwards.

A pair of differential springs 86 extends from a forward position 88 on the escapement plate 78 to two levers 90 which are pivoted and connected to a clutch mechanism on each end of the drive shaft 68. The operation of the springs 86 and levers 90 is to uncouple one of the driver spools 48A, B, C & D, 58A, B, C & D from the drive shaft 68. Thus, rotation of the escapement plate 78 causes a differential load in the pair of springs 86 which declutches the driver spool 48A, B, C & D, 58A, B, C & D connected to the locked trolley 16,20.

In another embodiment springs (not shown) are provided, preferably attached to each trolley 16,20. The springs provide spring assistance at the commencement of the propulsion stroke to accelerate the trolley. At the start of the propulsion stroke, the foot is vertically below the operator, which in some configurations does not provide the best leverage for a backward thrust. The springs may be tensioned by a downward movement of the foot.

Details of the clutches for driver spools 48A, B, C & D, 58A, B, C & D are shown in FIGS. 6, 7 and 7A. The levers 90 from the differential springs 86 as shown in FIG. 5, connect to a centre rod 92 which is stationary and extends through the drive shaft 68. Flanges 94 are provided on each drive shaft 68 inboard of the driver spools 48A, B, C & D, 58A, B, C & D and slots 96 in the flanges 94, as shown in FIG. 7, have pins 98 extending from the driver spools 48 A, B, C & D, 58A, B, C & D, through slots 96, thus torque is transmitted by the pins 98 passing through the slots 96 to the flange 94 to rotate the drive shaft 68. The slots 96 allow a small angular displacement between each driver spool to ensure the rearward moving trolley 16,20 can be moved a short distance in the rear direction from the other trolley 16,20 during the escape movement and before declutching takes place. This movement of the trolley 16,20 rotates the escapement plate 78 and thereby causes the declutching movement easy disengagement of the inactive driver spool. In operation each driver spool has a connection to the centre rod 92 and is able to slide on the drive shaft 68 by means of movement of levers 90 and the centre rod 92. Thus, the pins 98 from one driver spool engage in the slots 96 on one side and disengage pins from the other driver spool on the other side.

In the embodiment shown in FIG. 7A, the flange 94 is rectangular in shape and does not have slots 96 as shown in FIG. 7. The long side of the rectangular flange 94 engages the pins 98 and provides a limited rotation, as shown in dotted lines in FIG. 7. This embodiment may be used instead of that shown in FIG. 7.

Figure 8:
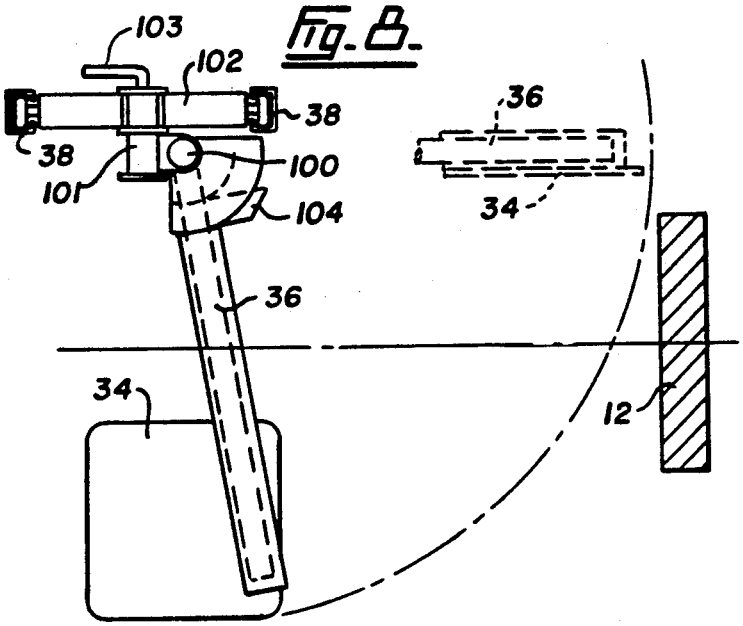
FIG. 8 is a forward view of a paddle arrangement according to one embodiment of the present invention.
Figure 9:
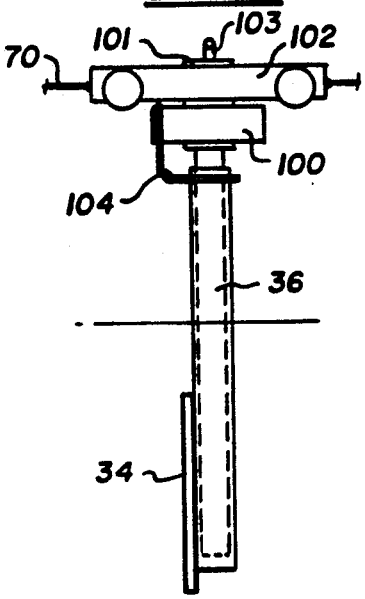
FIG. 9 is a side view of the paddle arrangement shown in FIG. 8.

Details of the paddle arrangement are shown in FIGS. 8 and 9 wherein the paddle blade 34 is connected to a paddle arm 36. The paddle arm 36 in turn has a pivoted connection 100 to a support member 101, which has a vertical shaft extending vertically through the centre of a paddle trolley 102 that moves backwards and forwards in the paddle guide channels 38. A hand lever 103 is shown connected to the top of the vertical shaft of the support member 101. With the paddle blade 34 in the position shown in FIGS. 8 and 9, a propulsion stroke will move the water craft through the water in a forward direction. When the hand lever 103 is turned through 180°, the paddle blade 34 is positioned so a return stroke of the trolleys 16,20 moves the water craft backwards through the water thus allowing an operator to manoeuvre the water craft. A locking mechanism (not shown) is provided to ensure the support member can be locked in the two positions, either for forward movement or backwards movement of the water craft. Furthermore in another embodiment down locks may be provided to keep the paddle arm 36 substantially vertical, and this avoids the necessity of having a vertical shaft joining the support member 101 to the paddle trolley 102. There is no need to rotate the support member 101 as the paddle blade 34 does not lift out of the water when it is down locked.

The paddle transmission cords 70 are connected to the trolley 102 so movement of the transmission cords 70 moves the trolley 102 backwards and forwards in the paddle guide channels 38. During the propulsion stroke, with the support member 101 locked in the normal position, the paddle arm 36 projects downwards and the paddle blade 34 faces across the direction of movement to give the maximum propulsion force. On the return stroke, the paddle arm 36 pivots upwards and also rotates through approximately 90° to the direction of movement of the vessel, thus the paddle blade 34 is substantially horizontal to the surface of the water and does not provide a drag on the water craft for the return stroke. Rotation of the paddle blade 34 is caused by water pressure acting on the surface of the blade 34 and a bevel gear 104 raises the paddle arm 36 primarily caused by the water pressure. The bevel gear 104 controls both angular movements thus ensuring that the blade 34 is just above the water and is substantially horizontal.

Whereas FIGS. 8 and 9 show a bevel gear 104 for rotating the paddle arm 36 when it pivots upwards, other mechanisms may be provided such as cords passing over fixed segments that cause the arm to rotate through approximately 90° when being pivoted between the vertical and horizontal positions.

Figure 11:
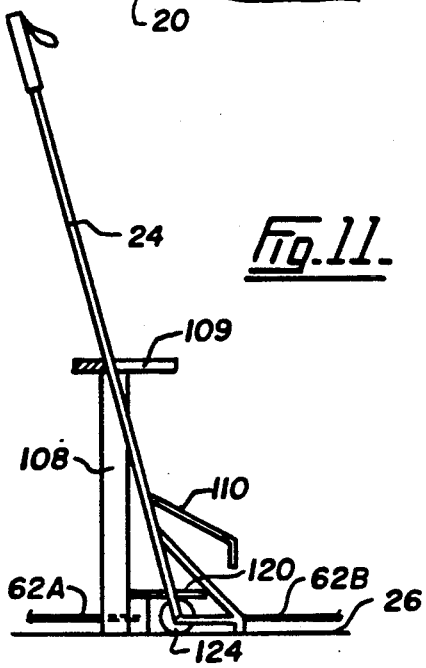
FIG. 11 is a side elevation of a pole in a forward position.
Figure 10:
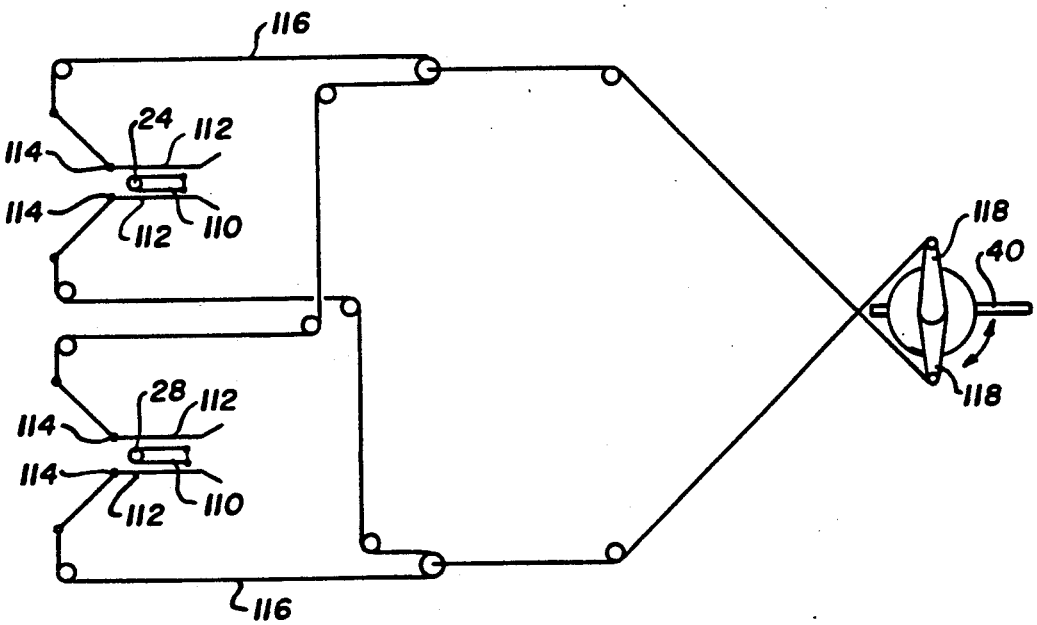
FIG. 10 is a schematic view showing the cable arrangement for steering the water craft.

The steering mechanism is illustrated in FIGS. 10 to 14 and is operated by rotating one or other of the poles 24,28 when the poles are in the forward position. As shown in FIG. 11, the first pole 24 extends upwards from a pole trolley 106 that moves backwards and forwards in the first pole guide channel arrangement 26 as shown in FIG. 1. The transmission cords 62 are attached to the pole trolley 106 and when in the forward position, the first pole 24 fits into a support 108 which extends up and is rigidly attached to the frame 14 and has a top V-slot 109 therein. Thus when the first pole 24 is in the forward position and is locked in that position, the first pole 24 fits into the V-slot 109 in the support 108 and becomes rigid to the extent that it does not move sideways and therefore can be used by the individual for bracing and balance on the water craft to counter rolling and pitching. Two supports 108 are provided, one for each pole. The poles each have a steering arm 110 projecting backwards and each pole when in the V-slot 109 can be rotated by manually twisting it in the forward position to permit the steering arm to contact steering levers 112 attached to the supports 108, as shown in FIG. 10. The levers 112 are pivoted at pivot points 114 and have ends connected to a plurality of steering cables 116 which pass around a number of sheaves as shown in FIG. 10 and connect to steering arms 118 to rotate the rudder 40

Figure 12:
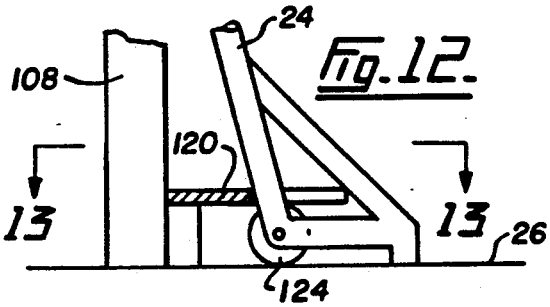
FIG. 12 is a sectional detail view of a pole trolley in a forward position.
Figure 13:
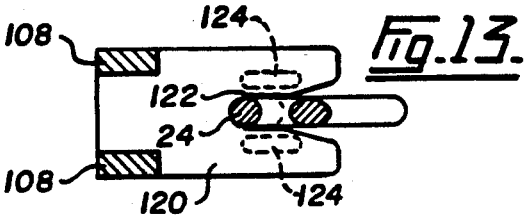
FIG. 13 is a sectional view taken at line 13—13 of FIG. 12.

FIGS. 12 and 13 show a lower plate 120 with a lower V-slot 122 therein which supports the pole 24. As can be seen in FIG. 13 the pole trolley 106 has two wheels 124 which fit underneath the lower plate 120 when the pole 24 is in the forward position. Thus the pole 24 is rigidly held between the top V-slot 109 and the lower V-slot 122 so it provides support for the operator. Also, the pole 24 cannot be lifted up because the wheels 124 are prevented from moving by the lower plate 120. The pole trolley 106 is locked in the forward position by the drive cord 62A and return cord 62B.

An anti-clockwise rotation of either one of the poles 24,28 in the V-slots 109 produces a similar rotation of its corresponding steering lever 112 causing a tension in the attached cable 116. When the cable attached to one of the steering arms 118 is tensioned, a small rotation of that steering arm 118 occurs and this moves the rudder 40 so the direction of the water craft is changed. In one embodiment, the mechanism is designed so that a 90° rotation of one pole produces a 45° rotation of the rudder 40. When both poles are in the forward position, and in the top V-slot 109 and the lower V-slot 122, a 90° anti-clockwise rotation of both poles produces a 90° rotation of the rudder which causes a deceleration of the movement of the water craft through the water. This arrangement is not required when the paddle support member 101 can be turned through 180° , and a reverse power stroke applied.

In operation the second trolley 20 and the first pole 24 are linked and act in conjunction and the first trolley 16 and the second pole 28 act in conjunction. The escape mechanism 74 ensures that one trolley and one pole are locked in the forward position. With the pole in the V-slots 109 and 122 at the forward position, the support 108 permits the individual to brace against roll and pitch of the water craft. Furthermore, when one pole is in the forward position rotation of that pole operates the rudder to control the direction of movement of the water craft in the water. The propelling mechanism provides an efficient method of utilizing human power to propel a small water craft and also provides training for cross-country skiing.

Figure 14:
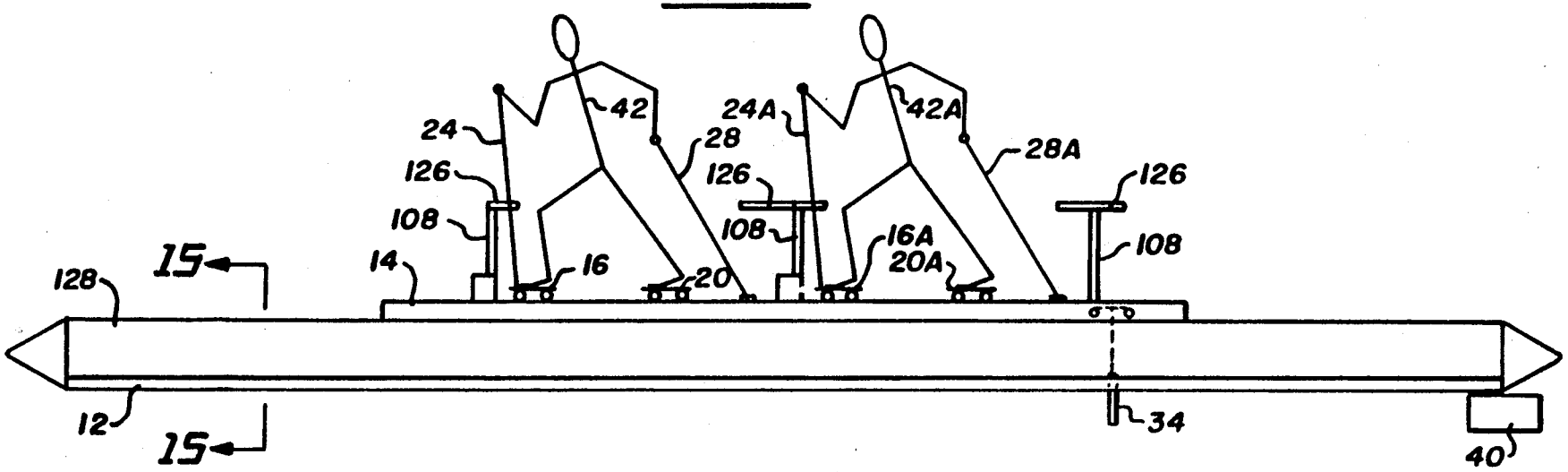
FIG. 14 is a schematic longitudinal view showing a two person water craft according to another embodiment of the present invention.

A further embodiment of a water craft according to the present invention is shown in FIG. 14 wherein two persons are positioned in tandem to drive the craft. The trolleys 16 and 20 for the leading operator 42 are connected by cables to the trolleys 16A,20A for the second operator 42A. Similarly, the poles 24,28 for the leading operator are connected by cables to the poles 24A,28A of the second operator 42A. This requires the leg and arm movement of both operators to work together. Seats 126 are provided behind each operator. The seat 126 for the leading operator 42 is shown integral with the support 108 for the poles 24A,28A of the second operator 42A. The seats may be folded down.

Figure 15:
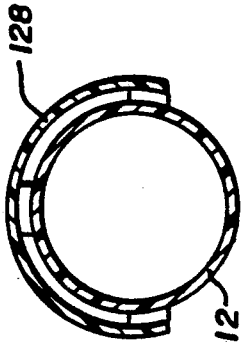
FIG. 15 is a sectional view taken at line 15—15 of FIG. 14 through one of the two floats.

In the embodiment shown in FIG. 14 and FIG. 15, the floats 12 are inflated rubber cylindrical sections which support a frame 128. Sections are supplied for each float 12 and the frame 128 is collapsible, as is the support frame 14 so the craft can be disassembled for ease of transportation.

Various changes may be made to the embodiments shown herein without departing from the scope of the present invention which is limited only by the following claims. For instance the propelling mechanism may be changed so that motion of the trolley and poles rotates a propeller, propellers, paddle wheel, or paddle wheels to provide propulsion.

The embodiments of the present invention in which an exclusive property or privilege is claimed are defined as follows:

1. An individual propelled water craft comprising:

two longitudinal floats adapted to float on water;

connecting frame means supporting the two floats in a spaced apart and parallel configuration;

first guide means mounted on the frame means having a first foot supporting trolley constrained to move backwards and forwards within the first guide means, the first guide means having a first locking position in a forward location;

second guide means substantially parallel to the first guide means, mounted on the frame means having a second foot supporting trolley constrained to move backwards and forwards within the second guide means, the second guide means having a second locking position in a forward location;

interchanging means to lock the first trolley in the first locking position when the second trolley is moved backwards within the second guide means, and interchanging means to lock the second trolley in the second locking position when the first trolley is moved backwards within the first guide means;

propulsion means for moving the craft on water when the first trolley or second trolley are moved backwards and forwards in the first guide means or the second guide means, and steering means to direct direction of movement of the craft on water.

2. The water craft according to claim 1 wherein the interchanging means comprises an escapement mechanism that releases the first trolley from the first locking position when the second trolley is moved forward into the second locking position, and releases the second trolley from the second locking position when the first trolley is moved forward into the first locking position.

3. The water craft according to claim 1 including a first pole having a handle grip at the top thereof, the first pole having a first sliding bottom portion constrained to move backwards and forwards within a first pole guide means, a second pole having a handle grip at the top thereof, the second pole having a second sliding bottom portion constrained to move backwards and forwards within a second pole guide means, the first pole guide means substantially parallel to and located exterior of the first guide means and the second pole guide means substantially parallel to and located exterior of the second guide means, and linking means wherein the first trolley is linked to move with the second sliding bottom portion of the second pole and the second trolley is linked to move with the first sliding portion of the first pole.

4. The water craft according to claim 3 wherein the first pole and the second pole each have individual supports extending from the frame means to constrain the first pole and the second pole from movement, except rotational movement about the pole axis, when each pole is in a forward position to provide a brace for an individual.

5. The water craft according to claim 4 wherein the steering means includes a steering arm connected to each of the first pole and the second pole, the steering arm engaging lever means having cable connections to rotate a rudder when the first pole or the second pole is in a forward position, the first pole and the second pole being rotatable so the steering arm engages the lever means to rotate the rudder.

6. The water craft according to claim 3 including foot supporting trolleys and poles for two operators positioned in tandem.

7. The water craft according to claim 3 wherein the first trolley, the second trolley, and first sliding bottom portion and the second sliding bottom portion are each connected to cable means which rotate a drive shaft when the first trolley and the second sliding bottom portion or the second trolley and the first sliding bottom portion move backwards and forwards.

8. The water craft according to claim 1 wherein the first trolley and the second trolley are each connected to cable means which rotate a drive shaft when the first trolley or the second trolley move backwards and forwards.

9. The water craft according to claim 8 wherein the drive shaft moves a cord extending between two pulleys in a direction parallel to the first and second guide means, and including paddle means connected to the cord to provide the propulsion means for moving the water craft.

10. The water craft according to claim 9 wherein the paddle means is moved backwards by the cord in a propulsion stroke, and forward by the cord in a return stroke, and wherein the paddle means has a blade surface to push against the water for the propulsion stroke and including pivot means to raise the blade surface out of the water for the return stroke.

11. The water craft according to claim 10 wherein movement of the paddle means in the propulsion stroke is greater than movement of the first trolley or second trolley in the propulsion stroke.

12. The water craft according to claim 9 wherein the paddle means is supported below the connecting frame by a carriage means constrained to move within a paddle guide means attached to the connecting frame.

13. The water craft according to claim 11 wherein the paddle means comprises a blade surface attached to a paddle arm supported beneath the carriage means, the blade surface to push against the water for the propulsion stroke and including pivot means to raise the blade surface out of the water for the return stroke, including reversal means to reverse the blade surface in the water so that water craft can be propelled in either direction.

* * * * *